US006571756B1

(12) United States Patent
Rosskamp et al.

(10) Patent No.: US 6,571,756 B1
(45) Date of Patent: Jun. 3, 2003

(54) TWO-CYCLE ENGINE WITH A STRATIFIED CHARGE

(75) Inventors: Heiko Rosskamp, Adelberg (DE); Hans Nickel, Cottenweiler (DE); Axel Klimmek, Schwaikheim (DE); Thomas Stark, Waiblingen (DE); Peter Pretzsch, Schorndorf (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/889,065

(22) PCT Filed: Jan. 7, 2000

(86) PCT No.: PCT/EP00/00067

§ 371 (c)(1),
(2), (4) Date: Jan. 6, 2001

(87) PCT Pub. No.: WO00/40843

PCT Pub. Date: Jul. 13, 2000

(30) Foreign Application Priority Data

Jan. 8, 1999 (DE) ..... 199 00 445

(51) Int. Cl.[7] ..... F02B 33/04
(52) U.S. Cl. ..... 123/73 PP; 123/73 A
(58) Field of Search ..... 123/73 PP, 73 R, 123/73 A, 73 B, 432, 433, 575, 585

(56) References Cited

U.S. PATENT DOCUMENTS

| | | | | |
|---|---|---|---|---|
| 4,000,723 A | * | 1/1977 | Boyesen | 123/73 AA |
| 4,075,985 A | | 2/1978 | Iwai | |
| 4,481,911 A | | 11/1984 | Sheaffer et al. | |
| 5,284,111 A | * | 2/1994 | Geyer et al. | 123/73 C |
| 5,425,346 A | | 6/1995 | Mavinahally | |

FOREIGN PATENT DOCUMENTS

| | | |
|---|---|---|
| AT | 397 837 B | 11/1993 |
| DE | 21 51 941 | 4/1973 |
| DE | 26 50 834 | 6/1977 |
| DE | 37 22 424 A1 | 1/1988 |
| GB | 2 022 699 A | 12/1979 |
| WO | WO 98/17902 | 4/1998 |

OTHER PUBLICATIONS

Patent Abstracts of Japan 57183520 published Nov. 11, 1982.

Patent Abstracts of Japan 61096129 published May 14, 1986.

* cited by examiner

*Primary Examiner*—Tony M. Argenbright
*Assistant Examiner*—Katrina B. Harris
(74) *Attorney, Agent, or Firm*—R W Becker & Associates; R W Becker

(57) ABSTRACT

The invention relates to a two-cycle engine for a drive engine in a portable, manually operated tool. The combustion chamber formed in a cylinder is delimited by a piston that moves up and down, whereby the piston, by means of a connecting rod, drives a crankshaft rotatably mounted in a crankcase. The combustion chamber has an outlet for removing waste gases, and provided for supplying a fuel/air mixture prepared by a mixture preparation device, and combustion air, are gas-supplying channels that open into the combustion chamber. In order to reduce scavenging losses, it is provided that for the entire duration of the gas exchange exclusively air flows in the area near the outlet and exclusively fuel/air mixture flows out of the crankcase in the area further away from the outlet.

18 Claims, 5 Drawing Sheets

Fig. 9
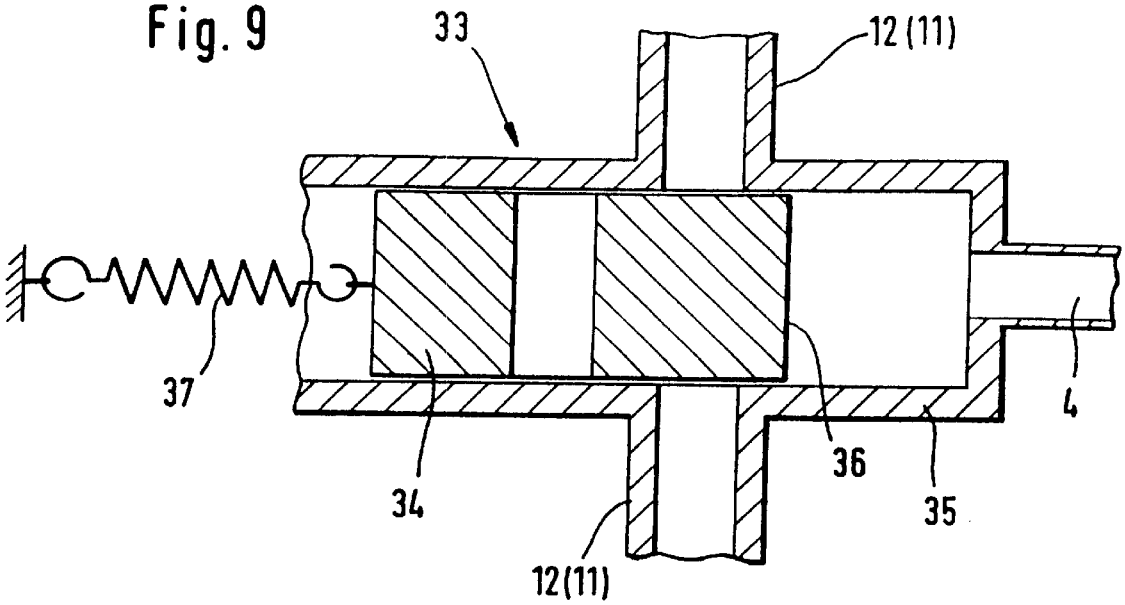
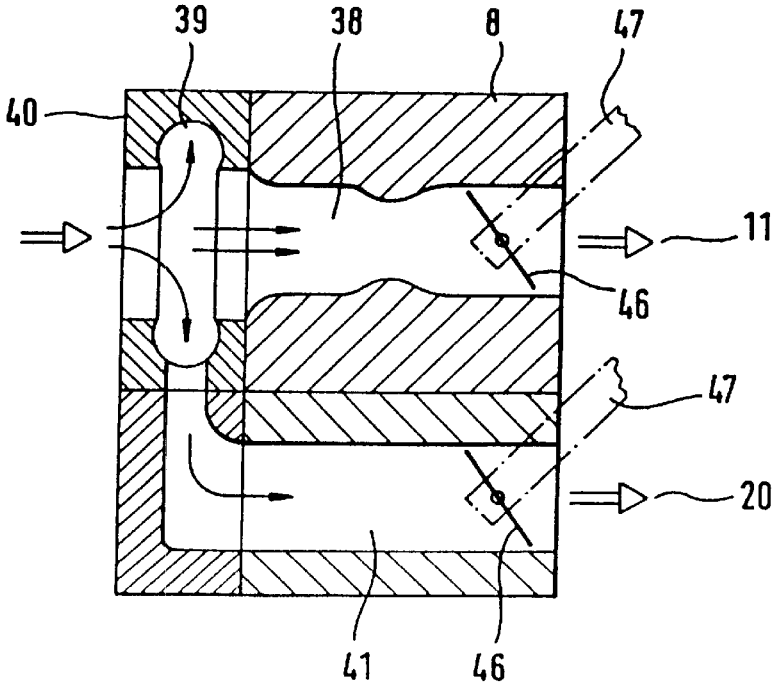
Fig. 10

TWO-CYCLE ENGINE WITH A STRATIFIED CHARGE

BACKGROUND OF THE INVENTION

The present invention relates to a two-cycle engine, in particular for use as a driving engine in a portable, manually operated tool.

Due to their low power/weight ratio, two-cycle engines are particularly suited for use as drive motors in manually operated, portable tools such as chainsaws, cut-off machines, blowers, brush cutters, and the like.

Due to the manner in which the two-cycle engine operates, the inflowing fresh mixture displaces the waste gases, forcing them out of the combustion chamber into the outlet, whereby it is understood that a portion of the fresh mixture also flows out through the outlet without having undergone combustion. These so-called scavenging losses are responsible for waste gases with high concentrations of pollutants, in particular high amounts of hydrocarbons.

The object of the invention is to further develop a two-cycle engine of the above general type such that the scavenging losses are reduced, and thus the quality of the waste gases is improved, with a low degree of complexity in terms of construction.

SUMMARY OF THE INVENTION

This object is achieved inventively in that for the duration of the scavenging cycle largely fuel-free gas flows in the area of said combustion chamber near said outlet, and in that for the duration of the scavenging cycle fuel-rich gas overflows out of said crankcase in the area of said combustion chamber further away from said outlet.

The gas, which is largely free of fuel, usefully flows through channels near the outlet in the region near the outlet, while the fuel-rich gas that is needed for operating the internal combustion engine is usefully supplied via channels that are further away from the outlet. This means that the fuel-free gas can shield the outlet in the manner of a curtain of air so that the fuel-rich gas cannot flow out via the outlet. For this it is essential that largely exclusively fuel-free gas flow in for the entire period of the scavenging cycle, advantageously for the entire period that the channel near the outlet is open, and the fuel/air mixture for operating the combustion engine flows out of the crankcase exclusively via the channels further away from the outlet. The gas portions flowing out via the outlet are overwhelmingly the largely fuel-free gas, which is why it is possible to achieve good waste gas qualities with low proportions of hydrocarbons. Since the fuel/air mixture, and its oil, flow exclusively via the crankcase, good lubrication is ensured even when the quantity of oil is low. Supplying the fuel/air mixture exclusively via the crankcase makes it possible to reduce the quantity of oil added to the fuel, whereby the burned waste gases carry less pollutants.

The air-supplying channels that are close to the outlet are large in terms of volume, in particular several times larger in volume than the channels that are further from the outlet and that supply the fuel-rich gas. The volume of the air-supplying channels is provided structurally in a size in which it can receive the entire volume of air flowing into the combustion chamber during one gas exchange process. In this manner the fuel/air mixture entering the air-supplying channel from the crankcase during the gas exchange process is merely used for a propellant in order to force the air that is pre-positioned in the air-supplying channel near the outlet into the combustion chamber.

The valve via which the air flows out of an air intake member into the channel near the outlet is preferably a diaphragm valve, but can also be a check valve controlled by crankcase pressure.

In one preferred embodiment, a piston-controlled auxiliary window is arranged in the cylinder wall as the valve such that it is constantly covered by the piston skirt. Provided in the piston skirt itself is a connecting channel that in a pre-determined lift position of the piston interconnects the auxiliary window and the inlet window of an overflow channel near the outlet. This ensures that air supplied via the air intake member to the auxiliary window flows in via the connecting channel in the piston skirt into the overflow channel near the outlet, that is, the overflow channel is completely filled with air from the combustion chamber going in the direction of the crankcase. When the overflow channel near the outlet is opened, the pure air flows into the region near the outlet and forms a curtain that shields the outlet, preventing the inflowing fuel-rich gas further away from the outlet from flowing out.

In order to ensure that enough air comes in, the channels near the outlet advantageously communicate with an accumulator that is usefully filled with air via a diaphragm pump driven by oscillating crankcase pressure. During the entire gas exchange process, air flows out of the accumulator into the region of the combustion chamber near the outlet, whereby the fuel/air mixture is reliably shielded from the outlet.

In order to achieve control of the channels, in particular of the inlet channel supplying the fuel-rich gas or the overflow channels, arranged in the desired gas channel is a control valve actuated by crankcase pressure. The control valve is in particular a pressure-actuated valve slide that is force-actuated in its closed position by a spring.

BRIEF DESCRIPTION OF THE DRAWINGS

Additional features of the invention can be seen from the other claims, the specification, and the drawings, in which exemplary embodiments of the invention are described in detail in the following, and in which:

FIG. 9 schematically illustrates an inlet channel or overflow channel with a control valve built into the channel;

FIG. 10 schematically illustrates an arrangement for branching off clean air on a mixture preparation device.

DESCRIPTION OF THE DRAWINGS

Figure 1:
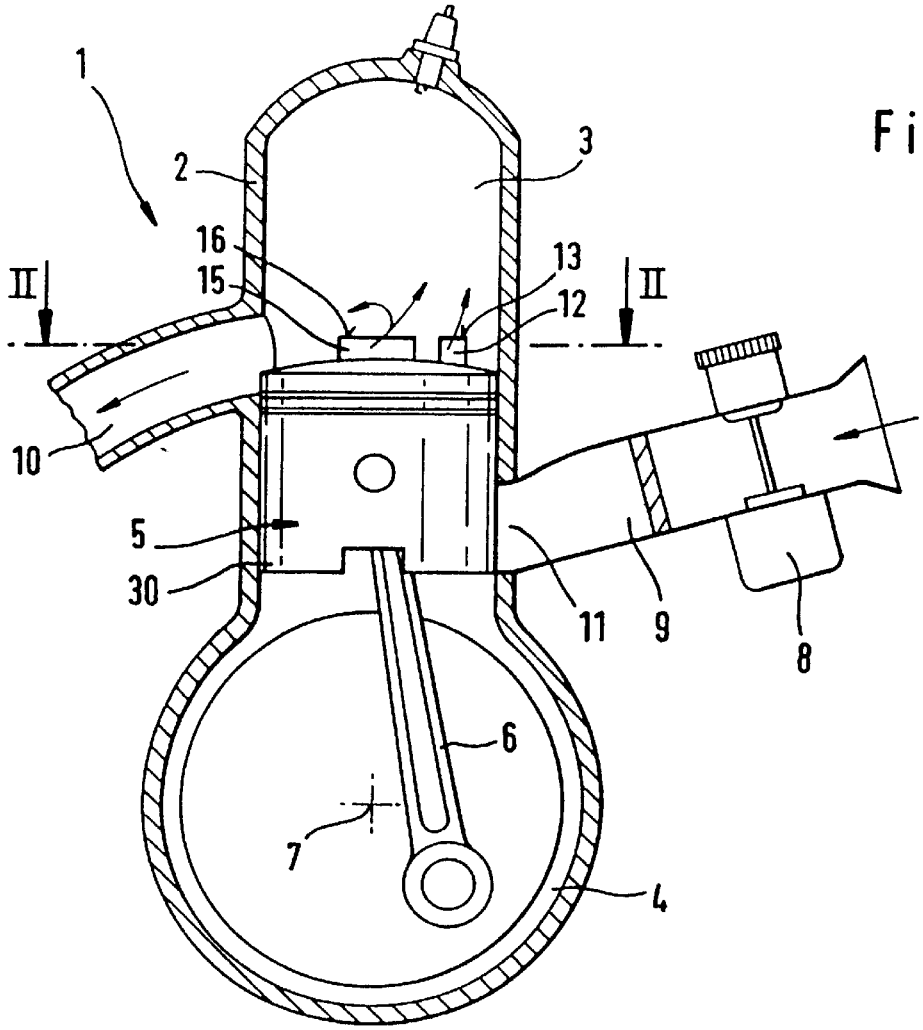
FIG. 1 is a schematic cross-sectional view of a two-cycle engine with four gas-supplying channels.
Figure 2:
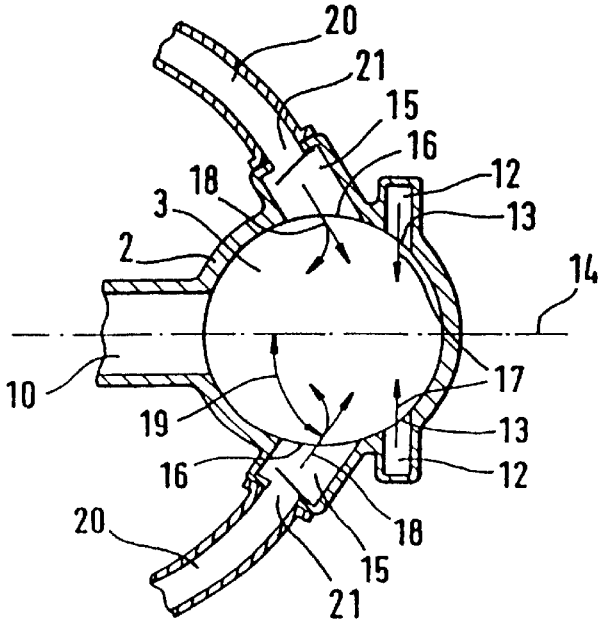
FIG. 2 is a cross-section along the line II—II in FIG. 1.

The two-cycle engine illustrated in FIGS. 1 and 2 can be employed advantageously in particular for a drive motor in a portable, manually operated tool such as a chainsaw, a cut-off machine, a brush cutter, hedge clippers, a blower, and the like.

The two-cycle engine 1 comprises a combustion chamber 3 formed in a cylinder 2, which combustion chamber is delimited to a crankcase 4 by a piston 5 that moves up and down. The piston 5 is connected via a connecting rod 6 to a crankshaft 7 that is rotatably borne in the crankcase 4 and is driven by the piston.

The combustion chamber 3 has an outlet 10 via which the waste gases flow out. The fuel/air mixture required for operating the internal combustion engine is prepared in a mixture preparation device 8, for instance a diaphragm carburetor, and is supplied to the crankcase 4 via an inlet channel 9 and an inlet 11. As FIG. 2 illustrates, the crankcase 4 communicates with the combustion chamber 3 through at least two overflow channels 12. The inlet windows 13 of the overflow channels 12, which windows open into the combustion chamber, are disposed approximately diametrically opposite one another relative to an axis of symmetry 14. In the top view illustrated in FIG. 2, the axis of symmetry 14 divides the outlet channel 10 into two equal parts; in the exemplary embodiment the axis of symmetry 14 is approximately the same as the central longitudinal axis of the outlet.

Disposed in the circumferential direction of the cylinder 2 between each of the overflow channels 12, which are arranged further away from the outlet, and the outlet 10 is at least one additional channel 15 near the outlet, the inlet windows 16 of which are disposed approximately diametrically opposite one another relative to the axis of symmetry 14. As FIG. 2 illustrates, the overflow channels 12 are arranged such that in the top view in FIG. 2 a fuel/air mixture flowing in in the direction of the arrow 17 enters the combustion chamber 3 at an angle to the axis of symmetry 14 that is less than or equal to 90°. The gas entering via the channels 15 in the direction of the arrow 18 has a flow direction that with the axis of symmetry 14 forms an angle 19 that is open to the outlet 10 and that is less than 90°, in particular is approximately 60°.

The combustion chamber 3 thus has four gas-supplying channels 12 and 15 and one outlet 10. Advantageously, more gas supplying channels can also be provided, whereby symmetry to the axis 14 should be maintained. It is also useful to arrange another gas channel between the overflow channels 12 opposing the outlet 10. The described invention can be employed advantageously in two-cycle engines with n channels.

Largely exclusively fuel-free gas, in particular air, is supplied to the combustion chamber 3 via the channels 15 near the outlet, while a rich fuel/air mixture enters the combustion chamber 3 via the channels 12 that are further from the outlet.

The channels 15 are expediently open to the crankcase 4, whereby an air intake member 20 opens in the region of the end with the combustion chamber, advantageously near the inlet window 16. As FIG. 2 indicates, the air intake member 20 advantageously opens into the channel 15 near the outlet via a diaphragm valve 21 embodied as a non-return valve 21 between the crankcase 4 and the inlet window 16. The volume of the channels 15 near the outlet is expediently greater than, in particular several times greater than, the volume of the channels 12 further away from the outlet. The design is such that the volume of the section of channel in the channel 15 supplying air between its end on the crankcase-side and the opening of the air intake member into the channel 15 is roughly equal to the overflow volume of air flowing out of the channel 15 into the combustion chamber 3 during a gas exchange process. Preferably the volume of the section of channel is greater than the overflow volume so that it is assured that largely exclusively air flows in during the entire period of a gas exchange process, that is, during the period that the inlet window 16 is open.

The piston 5 controls the inlet 11, the outlet 10, and the inlet windows 13 and 16 of the overflow channels 12 and 15 in a known manner. When the piston 5 moves upward, all of the channels that open into the combustion chamber 3 are closed, while the inlet 11 of the mixture preparation device 8 is opened to the crankcase 4. Due to the piston 5 moving upward, a vacuum occurs in the crankcase 4 that is equalized by the intake of a fuel/air mixture via the inlet 11. Since the channels 15 are advantageously open to the crankcase 4, the vacuum occurring in the crankcase 4 simultaneously causes intake of air via the air intake members 20 and the diaphragm valves 21, which are now open due to the pressure situation. The high-volume channels 15 that are near the outlet fill completely with air, whereby, as the pressure increasingly equalizes in the crankcase, the diaphragm valves 21 close and air is no longer permitted to flow in. Now there is largely pure air in the channels 15 that are near the outlet.

Figure 3:
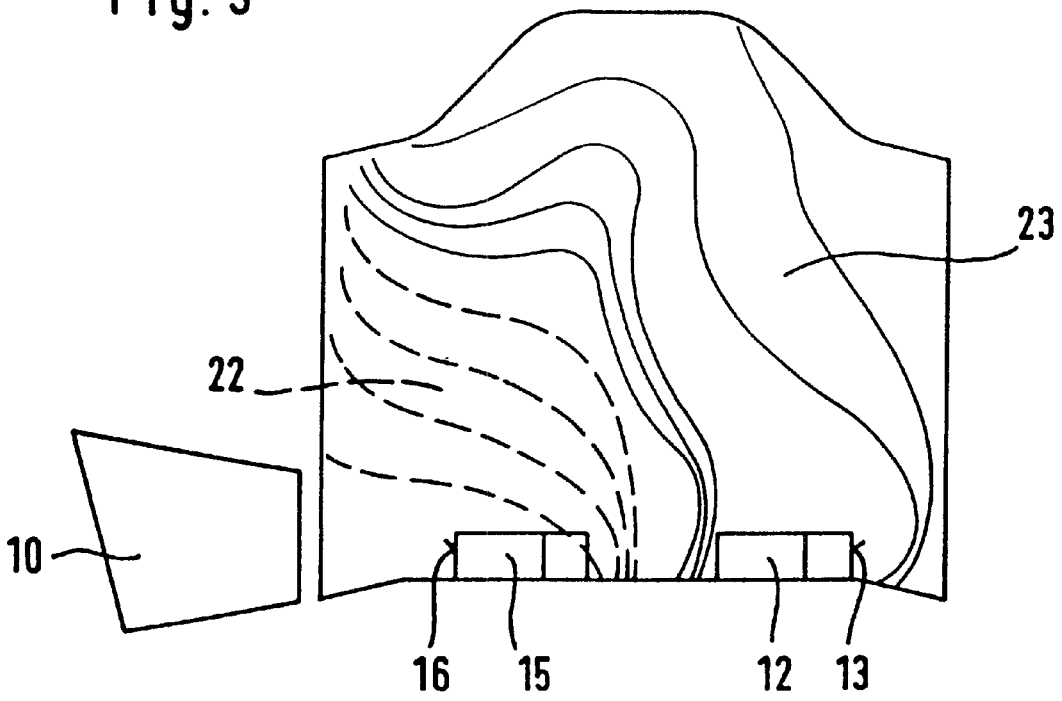
FIG. 3 schematically illustrates the stratified charge in the combustion chamber of the inventive two-cycle engine.
Figure 4:
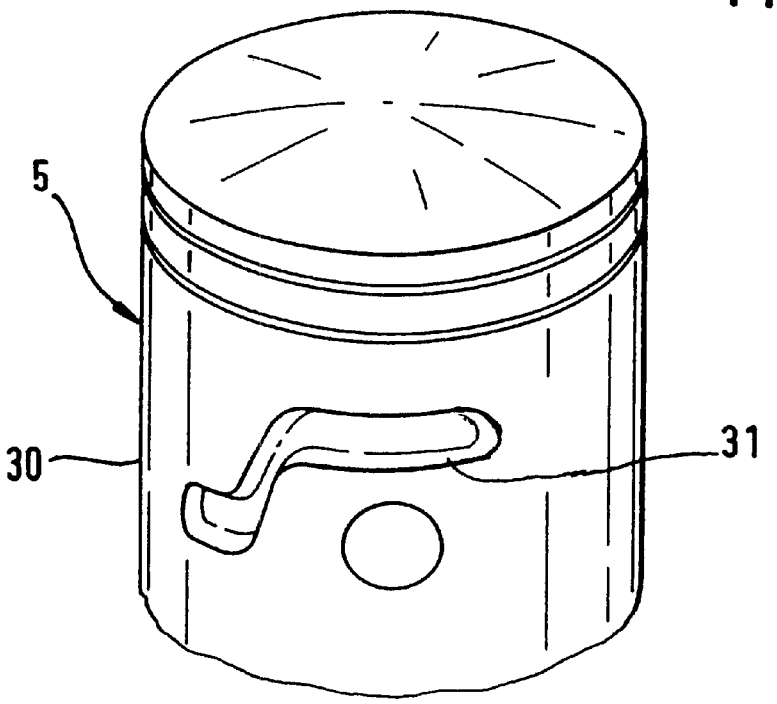
FIG. 4 is a schematic view of a piston with a connecting channel embodied in the piston skirt for supplying fuel-free gas.

After the ignition in the combustion chamber 3 that occurs in the region of the top dead center, the pressure from the explosion drives the piston 5 downward in the direction of the crankcase 4, whereby, due to the positions of the inlet windows 13 and 16, first the outlet 10 is opened and a portion of the waste gases, which are under pressure, flows out. As the piston 5 again continues its downward movement the inlet windows 13 and 16 of the channels 12 and 15 open,—simultaneously in the exemplary embodiment—whereby exclusively fuel/air mixture flows in via the overflow channels 12. Due to the overpressure that is building in the crankcase 4 and the channels 15 that supply air and that are open to the crankcase 4, the fuel/air mixture pulled into the crankcase 4 also enters the air-supplying channel 15 and, acting as a propellant, pushes the air located in the channel 15 near the outlet into the combustion chamber 3 via the inlet windows 16 as a predetermined quantity of air, namely fuel-free gas. During a gas exchange process, the zone of separation between the predetermined quantity of air in the channel 15 and the fuel/air mixture flowing in does not travel through the inlet window 16 into the combustion chamber. Thus, exclusively fuel-free air flows thereto, acting as a protective curtain 22 in front of the outlet 10, as illustrated in FIG. 3, so that the richer mixture 23 flowing in via the channel 12 cannot flow out via the outlet 10. This design substantially reduces scavenging losses, resulting in an improved quality of waste gases in the two-cycle engine.

Figure 5:
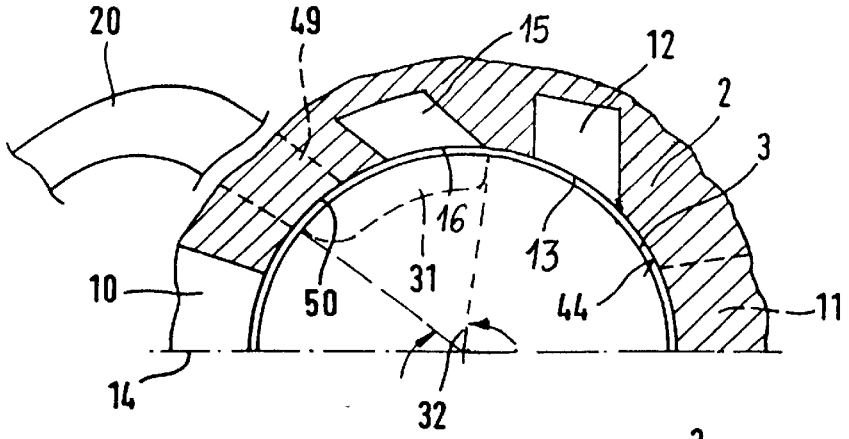
FIG. 5 is a partial cut-away through a cylinder for a piston in accordance with FIG. 4.
Figure 6:
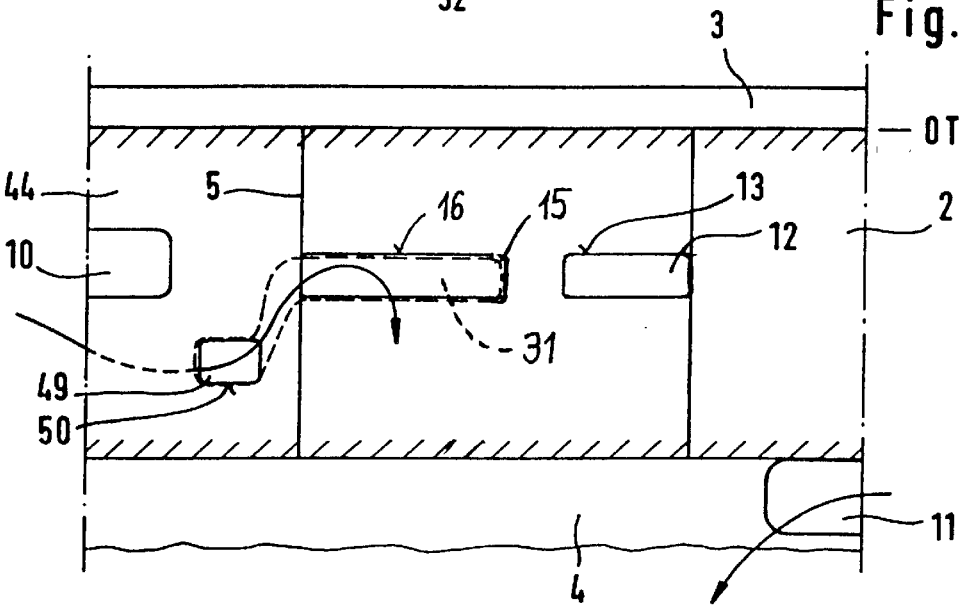
FIG. 6 schematically illustrates a section of the cylinder wall in accordance with FIG. 5 with the piston standing at the top dead center.
Figure 7:
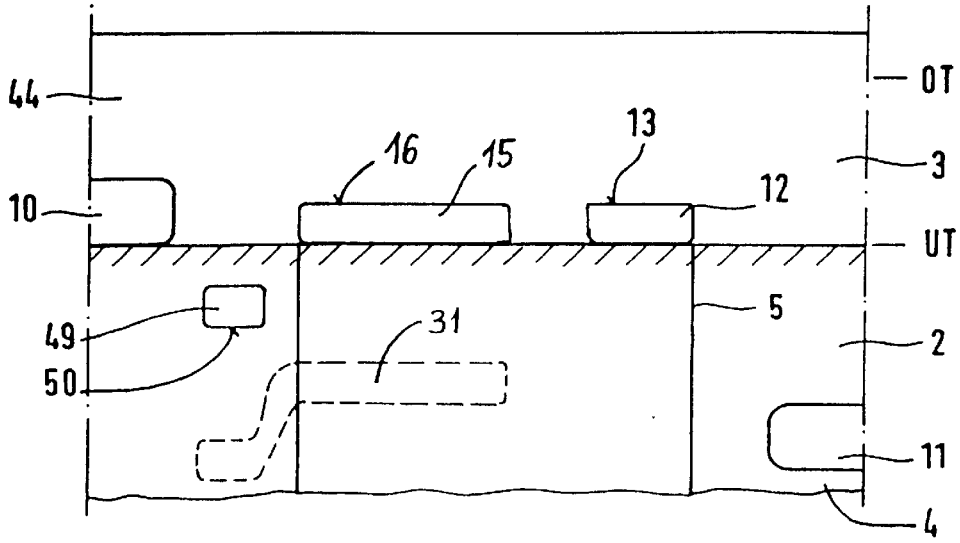
FIG. 7 schematically illustrates a section of the cylinder wall in accordance with FIG. 5 with the piston standing at the bottom dead center.

FIGS. 4 through 7 illustrate a section of a cylinder and the piston 5 of a multi-channel engine. The combustion chamber 3 of the cylinder 2 has an outlet 10 and overflow channels 12 and 15 on both sides of the axis of symmetry 14. The inlet channel 9 opens via the inlet 11 into the crankcase 4. All of the windows in the cylinder wall 44 are controlled by the piston 5. As can be seen in the 180° cylinder view in FIGS. 6 and 7, provided in the cylinder wall 44 is an auxiliary window 50 that clearly lies below the outlet 10 in terms of height. The auxiliary window 50 therefore lies completely in the path of the piston, that is, the auxiliary window 50 is covered by the piston skirt 30 in every position of the piston 5. In the exemplary embodiment illustrated, the auxiliary window 50 lies in the circumferential direction of the cylinder wall 44 between the outlet 10 and the overflow channel 15; other positions can also be advantageous.

Embodied in the piston skirt 30 of the piston 5 is a somewhat Z-shaped circumferential slot 31 that extends in the circumferential direction via an angle 32 that corresponds to the maximum distance in the circumferential direction between the vertical edges of the outlet window 16 of the air-supplying channel 15 and the auxiliary window 50 (FIG. 5). In the exemplary embodiment in accordance with FIGS. 4 through 7, the auxiliary channel 49 connected to the auxiliary window 50 near the outlet is embodied smaller in volume than the overflow channel 15. Correspondingly, the auxiliary window 50 of the auxiliary channel 49 near the outlet is smaller than the inlet window 16 of the overflow channel 15. The auxiliary channel 49 is connected to the air intake member 20, which supplies pure air. The connection should be. expediently provided such that the air flowing into the channel 15 near the outlet is not choked.

As FIG. 6 illustrates, the connecting channel embodied in the piston skirt 30 as a circumferential slot 31 connects the air-supplying auxiliary window 50 of the auxiliary channel 49 to the inlet window 16 of the overflow channel 15, which is connected to the crankcase 4, at approximately the top dead center position OT of the piston 5. The auxiliary channels 49 are closed relative to the crankcase 4 and can be connected, for instance, to an accumulator 24 in accordance with FIG. 8 so that at approximately the top dead center OT air enters the circumferential slot 31 through the auxiliary channel 49 and the auxiliary window 50 and from there flows via the inlet window 16 into the overflow channel 15. The overflow channel 15, embodied with a high volume, thus fills largely completely with pure air from the combustion chamber 3 going in the direction of the crankcase 4 so that, when the piston 5 travels downward in the direction of the bottom dead center position (UT), the channel volume with pure air is introduced to the fuel/air mixture flowing out of the crankcase 4 into the overflow channel 15. Since on the way to the bottom dead center UT the connection between the channels 49 and 15 is initially interrupted and the downward-travelling piston 5 leads to an increase in pressure in the crankcase 4, the air previously collected in the overflow channel 12 is also compressed. When the inlet windows 16 of the overflow channels 15 are opened, the compressed air therefore enters the combustion chamber 3 under pressure and forces the waste gases out of the combustion chamber 3. Largely exclusively pure air can escape via the outlet; the air previously collected in the overflow channels 15 constitutes a curtain of air 22 shielding the outlet 10, as illustrated in FIG. 3. The fuel/air mixture flowing out of the crankcase 4 via the overflow channels 12 is shielded from the outlet 10.

The Z-shaped connecting channel 31 in the piston skirt 30 for the introduced or tidal air is designed such that the inlet windows 16 and 50 open across their entire cross-section into the circumferential slot 31, that is, choking is largely prevented when the air crosses over from the air intake member 20 to the overflow channel 15.

FIGS. 4 through 7 use a four-channel engine to explain the tidal air in a overflow channel 15 leading from the crankcase 4 to the combustion chamber. The inventive thought to collect pure air in an overflow channel in the direction of the combustion chamber 3 can be applied in the same manner in a total of three, five, or more overflow channels, whereby the channels near the outlet supply pure air to the combustion chamber during the entire gas exchange process. Advantageously, the pistons 5 have a plurality of circumferential slots 31 in order to collect air in each channel near the outlet. Usefully, two circumferential slots 31 are provided, each of which lies on a longitudinal side of the axis of symmetry 14. If the auxiliary channels 49 are connected to the pure airside of an air filter, the connection of the auxiliary channel 49 to the overflow channel 15 occurs at a time at which there is a vacuum in the crankcase. Then pure air that is previously collected in the overflow channel 15 is drawn from the crankcase 4 via the overflow channel 15, the connecting channel 31, and the auxiliary channel 49.

Figure 8:
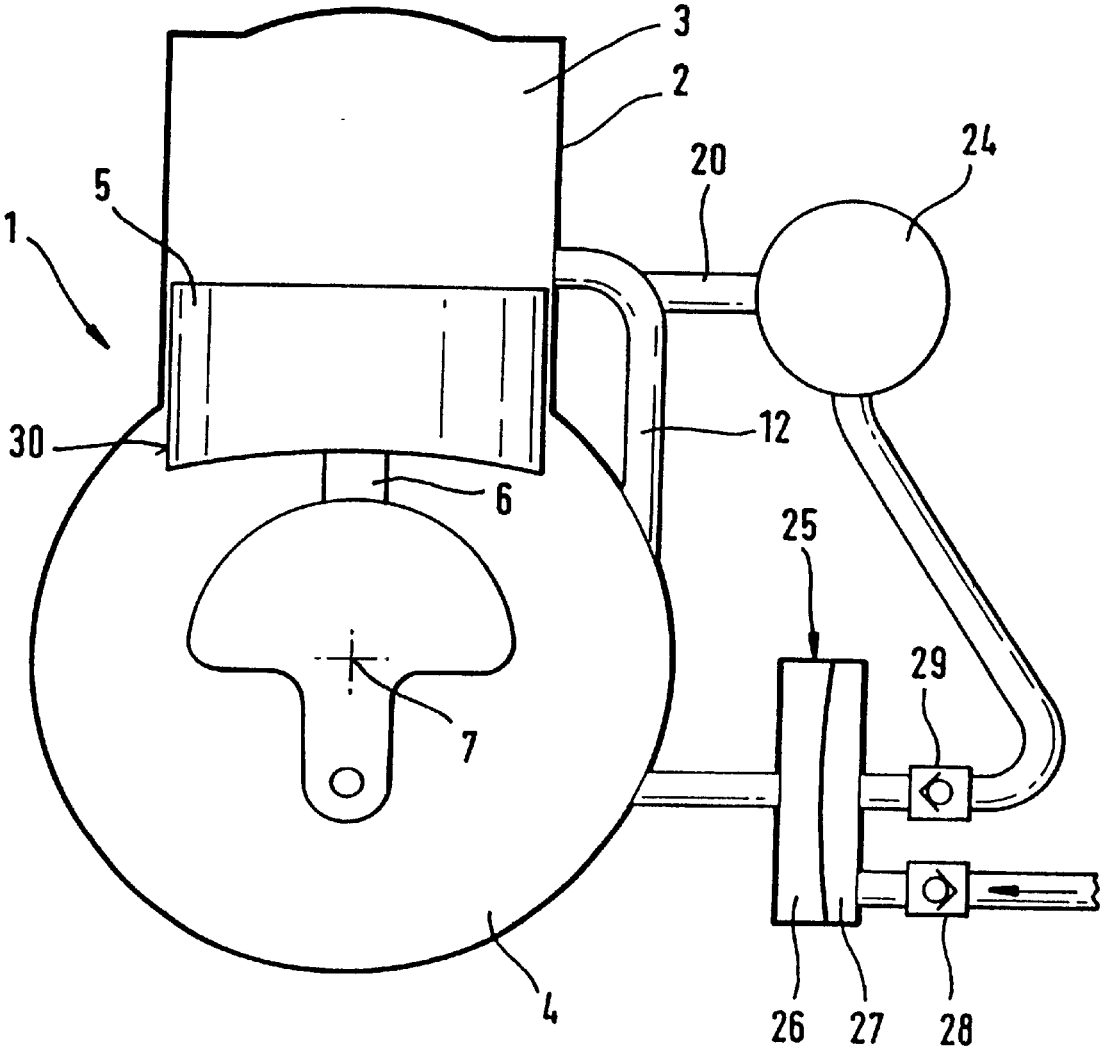
FIG. 8 schematically illustrates a combustion engine in accordance with the invention with air supplied under pressure for the channels near the outlet.

In the exemplary embodiment in FIG. 8, the air intake member 20 is connected to an accumulator 24 that is continuously charged during the operation of the combustion engine 1 via an air pump that is preferably embodied as a diaphragm pump 25. The diaphragm pump 25 is driven by the oscillating pressure in the crankcase; the working area 26 of the pump 25 is connected to the crankcase 4. The pump area 27 is connected via an intake valve 28 designed as a non-return valve to an air intake line and via a pressure valve 29, also embodied as a non-return valve, to the accumulator 24.

When the inlet window 16 of the overflow channels 15 near the outlet is opened, air under pressure is blown into the combustion chamber 3, whereby the curtain 22 shielding the outlet 10 builds up uniformly and resistive. During the pressurized feeding of the air into 10 the channel 15 near the outlet, it can be useful to choke or completely close the channel 15 near the outlet to the crankcase 4.

In the exemplary embodiments described, the piston 5 or its piston skirt 30 controls the inlet 11, outlet 10, and inlet windows 13 and 16 in the channels 12 and 15. This necessarily results in control times that cannot be changed because of the structure itself. In accordance with FIG. 9, it is advantageous to arrange, for instance in the air-supplying channel 15 for the mixture-supplying overflow channel 12, and/or the inlet channel 9, a control valve 33 that can be actuated deviating from the position of the piston 5. A valve member 34 is therefore provided in a valve housing 35. The valve member 34 in the illustrated exemplary embodiment is provided as a valve slide; pressure in the crankcase strikes the valve end 36. The valve member 34 is force-actuated in the blocking position illustrated in FIG. 9. Arranged on the side opposing the end face 36 is a spring 37 against whose force the valve member 34 can be displaced into the release position. The spring pre-tension is expediently adjustable, whereby the spring 37 can be a helical spring loaded against pulling.

For branching pure air, in accordance with FIG. 10, arranged on the mixture preparation device in the direction of flow in front of the Venturi section 38 is a baffle or aperture wheel 40 that has an interior circumferential slot 39 from which the air line 41 branches off. The circumferential slot 39 is semi-circular in cross-section, preferably with a circumference angle of about 270°. The air line can communicate directly with the air intake member 20 of the channels 15 near the outlet. Arranged in the air line 41 and in the mixture preparation device 8 are butterfly valves 46 that are advantageously coupled to one another as a function of position via an adjusting lever 47 in a manner not shown in greater detail.

The specification incorporates by reference the disclosure of German priority document 199 00 445.5 of Jan. 8, 1999 as well as European Patent Application priority document PCT/EP00/00067 of Jan. 7, 2000.

The present invention is, of course, in no way restricted to the specific disclosure of the specification and drawings, but also encompasses any modifications within the scope of the appended claims.

What is claimed is:

1. A two-cycle engine, comprising:

a cylinder in which is formed a combustion chamber;

a piston reciprocally disposed in said cylinder and delimiting said combustion chamber, wherein said piston, for driving a crankshaft, is connected by a connecting rod to said crankshaft, which is rotatably mounted in a crankcase;

wherein said combustion chamber has an outlet for the removal of waste gases; and wherein said combustion chamber has gas-conveying channels, which open into said combustion chamber, for supplying air for combustion and a fuel/air mixture prepared by a mixture preparation device, wherein for the duration of a scavenging cycle, essentially fuel-free gas flows in the vicinity of said outlet of said combustion chamber, and wherein for the duration of said scavenging cycle, fuel-rich gas flows out of said crankcase in a region of said combustion chamber remote from said outlet thereof, wherein via ones of said gas-conveying channels disposed in the vicinity of said outlet of said combustion chamber essentially only air is supplied, and via ones of said gas-conveying channels disposed remote from said outlet of said combustion chamber essentially only fuel/air mixture is supplied, wherein said air-conveying channel is open towards said crankcase, wherein in the vicinity of that end of said air conveying channel that faces said combustion chamber said air conveying channel communicates via a valve with an air intake member, and wherein said valve is formed by an auxiliary window that is slot-controlled by said piston.

2. A two-cycle engine according to claim 1, wherein a channel section of said air conveying channel, between an end on the crankcase side and where said intake member opens into said channel, has a structural volume that is at least approximately as large as an overflow volume that flows into said combustion chamber in a gas exchange phase, and which is preferably greater than said overflow volume.

3. A two-cycle engine according to claim 2, wherein said air intake member communicates with an accumulator.

4. A two-cycle engine according to claim 1 wherein fuel/air mixture entering said air conveying channel out of said crankcase serves merely as a propellant for introducing previously collected air into said combustion chamber.

5. A two-cycle engine according to claim 1, wherein said valve is a diaphragm valve that opens towards said air conveying channel in a direction of flow.

6. A two-cycle engine according to claim 1, wherein an accumulator supplies air to a region in the vicinity of said outlet of said combustion chamber.

7. A two-cycle engine according to claim 6, wherein said accumulator is supplied by a diaphragm pump that is driven by oscillating crankcase pressure.

8. A two-cycle engine according to claim 6, wherein air supplied to said combustion chamber, in the vicinity of said outlet thereof branches off via an aperture wheel ahead of a Venturi section of said mixture preparation device and is conveyed away via an air line from a semi-circular inner circumferential slot of said wheel.

9. A two-cycle engine according to claim 1, wherein a control valve that is actuated by crankcase pressure is disposed in one of said channels.

10. A two-cycle engine according to claim 9, wherein said control valve is-provided with a pressure-actuated valve member.

11. A two-cycle engine according to claim 10, wherein said valve member is a valve slide.

12. A two-cycle engine according to claim 10, wherein said valve member is urged into a blocking position by means of a spring.

13. A two-cycle engine, comprising:

a cylinder in which is formed a combustion chamber;

a piston reciprocally disposed in said cylinder and delimiting said combustion chamber, wherein said piston, for driving a crankshaft, is connected by a connecting rod to said crankshaft, which is rotatably mounted in a crankcase;

wherein said combustion chamber has an outlet for the removal of waste gases; and wherein said combustion chamber has gas-conveying channels, which open into said combustion chamber, for supplying air for combustion and a fuel/air mixture prepared by a mixture preparation device, wherein for the duration of a scavenging cycle, essentially fuel-free gas flows in the vicinity of said outlet of said combustion chamber, and wherein for the duration of said scavenging cycle, fuel-rich gas flows out of said crankcase in a region of said combustion chamber remote from said outlet thereof wherein via ones of said gas-conveying channels disposed in the vicinity of said outlet of said combustion chamber essentially only air is supplied, and via ones of said gas-conveying channels disposed remote from said outlet of said combustion chamber essentially only fuel/air mixture is supplied, wherein said air-conveying channel is open towards said crankcase, wherein in the vicinity of that end of said air conveying channel that faces said combustion chamber said air conveying channel communicates via a valve with an air intake member, and wherein said valve is a check valve that is controlled by crankcase pressure.

14. A two-cycle engine, comprising:

a cylinder in which is formed a combustion chamber;

a piston reciprocally disposed in said cylinder and delimiting said combustion chamber, wherein said piston, for driving a crankshaft, is connected by a connecting rod to said crankshaft, which is rotatably mounted in a crankcase;

wherein said combustion chamber has an outlet for the removal of waste gases; and wherein said combustion chamber has gas-conveying channels, which open into said combustion chamber, for supplying air for combustion and a fuel/air mixture prepared by a mixture preparation device, wherein for the duration of a scavenging cycle, essentially fuel-free gas flows in the vicinity of said outlet of said combustion chamber, and wherein for the duration of said scavenging cycle, fuel-rich gas flows out of said crankcase in a region of said combustion chamber remote from said outlet thereof, wherein via ones of said gas-conveying channels disposed in the vicinity of said outlet of said combustion chamber essentially only air is supplied, and via ones of said gas-conveying channels disposed remote from said outlet of said combustion chamber essentially only fuel/air mixture is supplied, wherein said air-conveying channel is open towards said crankcase, wherein in the vicinity of that end of said air conveying channel that faces said combustion chamber said air conveying channel communicates via a valve with an air intake member, and wherein air supplied to said combustion chamber, in the vicinity of said outlet thereof, branches off via an aperture wheel ahead of a Venturi section of said mixture preparation device and is conveyed away via an air line from a semi-circular inner circumferential slot of said wheel.

15. A two-cycle engine according to claim 14, wherein said valve is a valve that is controlled by crankcase pressure.

16. A two-cycle engine according to claim 14, wherein said valve is formed by an auxiliary window that is slot-controlled by said piston.

17. A two-cycle engine according to claim 16, wherein said auxiliary window is an air conveying window disposed in said cylinder and in every position of said piston is covered by a skirt of said piston, wherein at least one communicating channel is provided in said piston skirt, and wherein said at least one communicating channel, in a prescribed position of said piston, interconnects said air conveying auxiliary window and an inlet window of said air conveying channel.

18. A two-cycle engine according to claim 17, wherein said at least one communicating channel is a circumferential slot that is open toward a wall of said cylinder.

* * * * *